US006771564B1

(12) United States Patent
Ramotowski et al.

(10) Patent No.: US 6,771,564 B1
(45) Date of Patent: Aug. 3, 2004

(54) SONAR DOME AND A MOUNTING BRACKET FOR REMOVABLY CONNECTING AN ACOUSTIC SENSOR ELEMENT TO A SONAR DOME

(75) Inventors: Thomas S. Ramotowski, Tiverton, RI (US); Patrick J. Monahan, Gales Ferry, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 11 days.

(21) Appl. No.: 10/663,056

(22) Filed: Sep. 15, 2003

(51) Int. Cl.[7] ..... H04R 1/44
(52) U.S. Cl. ..... 367/173
(58) Field of Search ..... 367/165, 173, 367/910

(56) References Cited

U.S. PATENT DOCUMENTS 4,300,219 A * 11/1981 Joyal ..... 367/174
5,265,069 A * 11/1993 Wardle ..... 367/173
6,341,661 B1 * 1/2002 Bick et al. ..... 181/110

FOREIGN PATENT DOCUMENTS

JP 08327726 * 12/1996 ..... H04R/1/44

* cited by examiner

*Primary Examiner*—Ian J. Lobo
(74) *Attorney, Agent, or Firm*—James M. Kasischke; Michael F. Oglo; Jean-Paul A. Nasser

(57) ABSTRACT

A mounting bracket for removably connecting an acoustic sensor element to an inside wall of a sonar dome of a marine vessel includes a first protrusion bonded at a first end thereof to the inside wall of the sonar dome, extending inwardly therefrom, and provided with a first widthwise extending slot proximate, but spaced from, the inside wall, and a second protrusion bonded at a first end to the sonar dome inside wall and extending generally parallel to and spaced from the first protrusion, the second protrusion being provided with a widthwise extending second slot in a side thereof, the second slot being opposed to and in alignment with the first slot. The slots are adapted to receive portions of the acoustic sensor element and to hold the acoustic sensor element in a position proximate to and removed from the inside wall of the sonar dome.

15 Claims, 5 Drawing Sheets

SONAR DOME AND A MOUNTING BRACKET FOR REMOVABLY CONNECTING AN ACOUSTIC SENSOR ELEMENT TO A SONAR DOME

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

This invention relates to marine sonar domes, and is directed more particularly to a mounting bracket for removably connecting an acoustic sensor element to an inside wall of a sonar dome, and to a sonar dome in which the acoustic elements are so mounted.

(2) Description of the Prior Art

Sonar bow domes are commonly fixed to submarines and military surface vessels beneath the water line and house acoustic sensor elements and electronics which serve to alert the vessel to the presence of an underwater vessel, such as a submarine and/or an approaching torpedo.

The domes have been constructed of two steels and rubber, and recently the U.S. Navy has been investigating the advantages of using a fiberglass-rubber-fiberglass composite material to make sonar devices for future classes of surface warships. Disposed within the domes are acoustic elements positioned on fixtures. The fixtures, or mounting brackets, are adhesively bonded to the inside surface of the dome.

There is a need for a mounting bracket which securely retains an acoustic element, but in a releasable fashion, facilitating quick and easy replacement of a damaged element.

There is further a need for a mounting bracket which releasably retains an acoustic element without an adhesive interconnection, such that the element is free of adhesive and therefore acoustically clear, so as not to interfere significantly with transmissions.

SUMMARY OF THE INVENTION

An object of the invention is, therefore, to provide a mounting bracket for fixing an acoustic element to the inside wall of a sonar dome, which mounting bracket is free from adhesive interconnecting bracket and the acoustic element, and is adapted for quick release of a damaged element, and which acoustic element is free-of adhesive and is acoustically transparent.

A further object of the invention is to provide a sonar dome featuring the improved acoustic element mounting bracket.

With the above and other objects in view, a feature of the present invention is the provision of a mounting bracket for removably connecting an acoustic sensor element to an inside wall of a sonar dome of a marine vessel. The mounting bracket includes a first protrusion bonded at a first end thereof to the inside wall of the sonar dome and extending inwardly therefrom, the first protrusion being provided with a first widthwise extending slot in a side thereof, the first slot being proximate, but spaced from the inside wall, and a second protrusion bonded at a first end thereof to the inside wall of the sonar dome and extending inwardly therefrom and generally parallel to and spaced from the first protrusion, the second protrusion being provided with a widthwise extending second slot in a side thereof, the second slot being opposed to and in alignment with the first slot. The slots are adapted to receive portions of the acoustic sensor element and retain the element in a position proximate to and removed from the inside wall of the sonar dome. At least one of the protrusions is sufficiently flexible to permit bending thereof to facilitate insertion or removal of the acoustic element and sufficiently rigid to snap back into a non-bent configuration.

In accordance with a further feature of the invention, there is provided a sonar dome assembly for marine vessels. The assembly includes a shell for attachment to an outboard surface of an underwater portion of a vessel, a plurality of mounting brackets fixed to an inboard surface of the shell, and a plurality of acoustic sensor elements releasably held on the mounting brackets. The mounting brackets each comprise first and second protrusions for retaining sensor elements mounted thereon spaced from the shell inboard surface. At least one of the first and second protrusions is sufficiently flexible to permit bending of the protrusion to facilitate insertion of the acoustic sensor element into the first and second slots, and is sufficiently rigid to snap back into a non-bent configuration to lock the acoustic sensor element in the first and second slots.

The above and other features of the invention, including various novel details of construction and combinations of parts, will now be more particularly described with reference to the accompanying drawings and pointed out in the claims. It will be understood that the particular dome and mounting bracket embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 1:
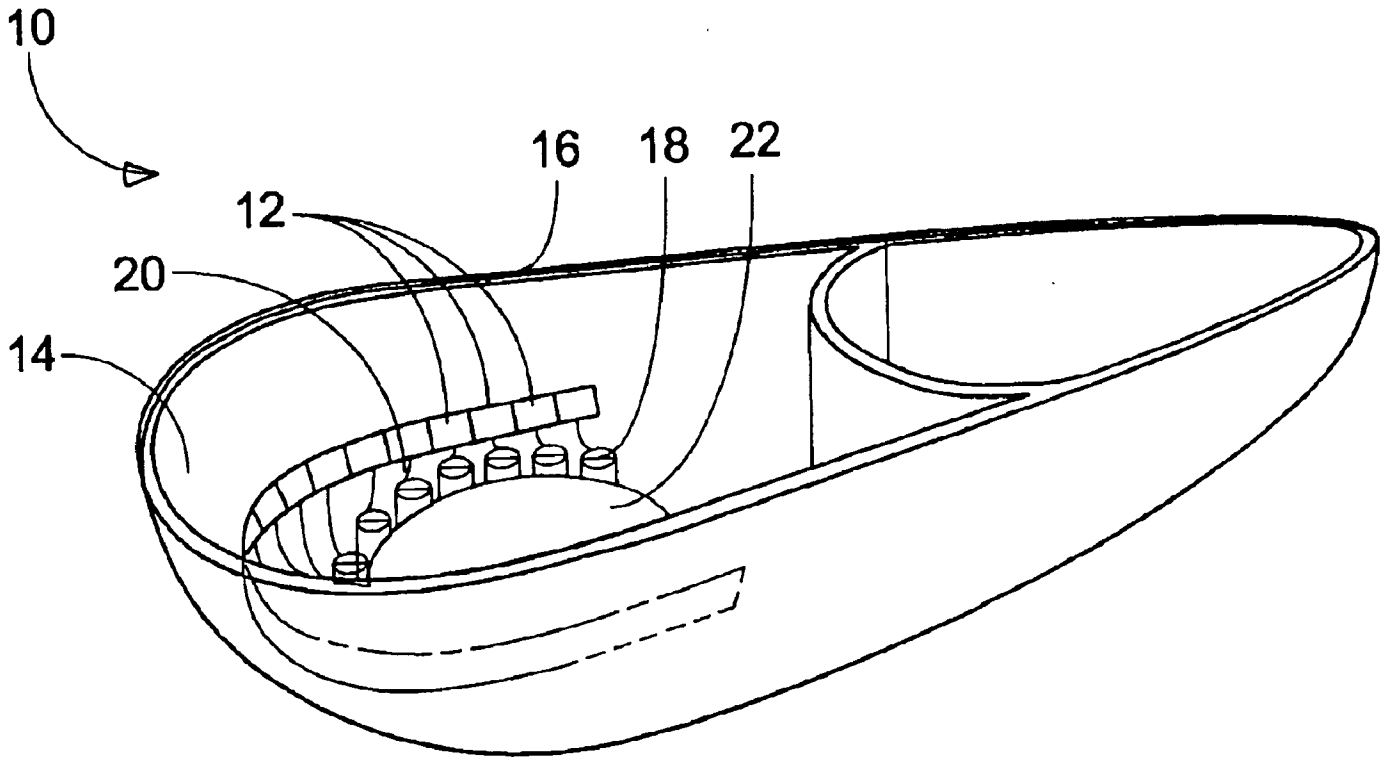
FIG. 1 is a diagrammatic perspective view of a marine vessel bow dome illustrative of an embodiment of the invention.
Figure 4:
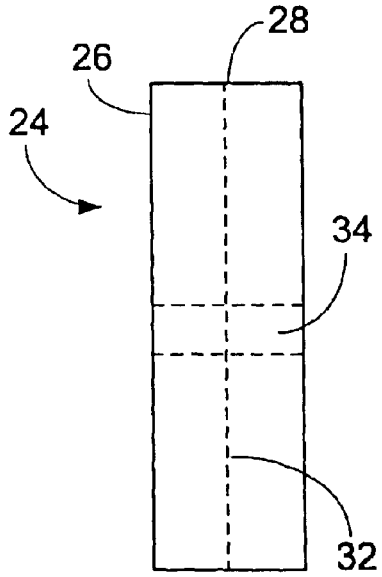
FIG. 4 is a top plan view thereof.
Figure 2:
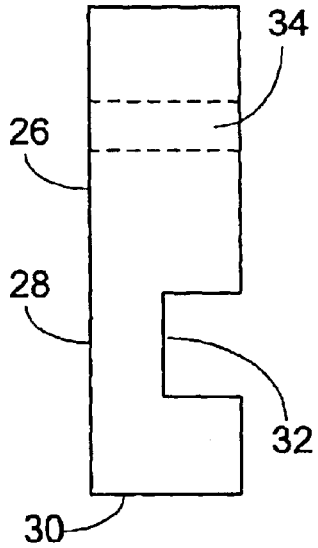
FIG. 2 is a front elevational view of one form of one portion of a mounting bracket for removably connecting an acoustic sensor element to an inside wall of a bow dome, illustrative of an embodiment of the invention.
Figure 3:
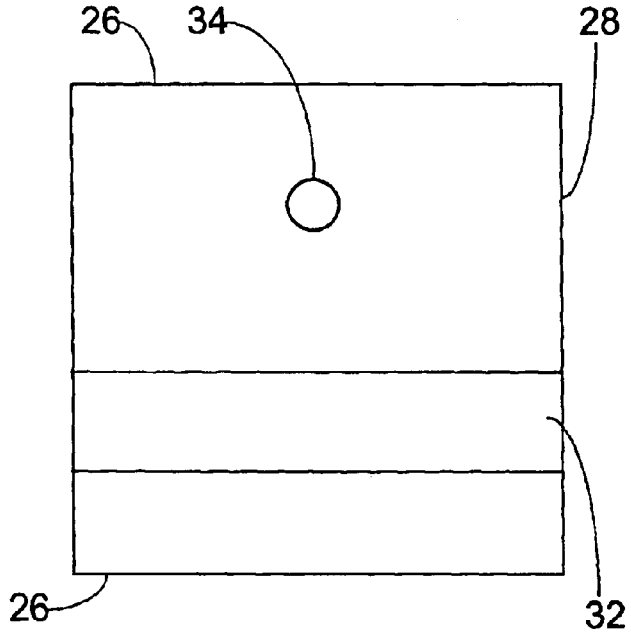
FIG. 3 is a Bide elevational view thereof.

Referring to FIG. 1, it will be seen that a sonar dome 10 includes a number of acoustic elements 12, each comprising a piezocomposite panel, fixed to an inside fiberglass surface 14 of a fiberglass/rubber composite shell 16. Shell 16 may be made of other materials which accept a bond, including fiberglass in and of itself, and steel and rubber. Each element 12 is connected to a canister 18 which houses the electronics for the element 12, as by a wire 20 interconnecting the element 12 and the respective canister 18. The canisters 18 are fixed to a supporting pedestal 22 in known fashion.

Referring to FIGS. 2–5, it will be seen that a mounting bracket 24 includes a first protrusion 26 comprising a block 28 of, for example, polyurethane. At a first end 30 thereof, the block 28 is fixed to the shell inside surface 14, as by an epoxy resin or other suitable adhesive system. The block 28 is provided with a widthwise slot 32 and, optionally, a bore 34.

Figure 5:
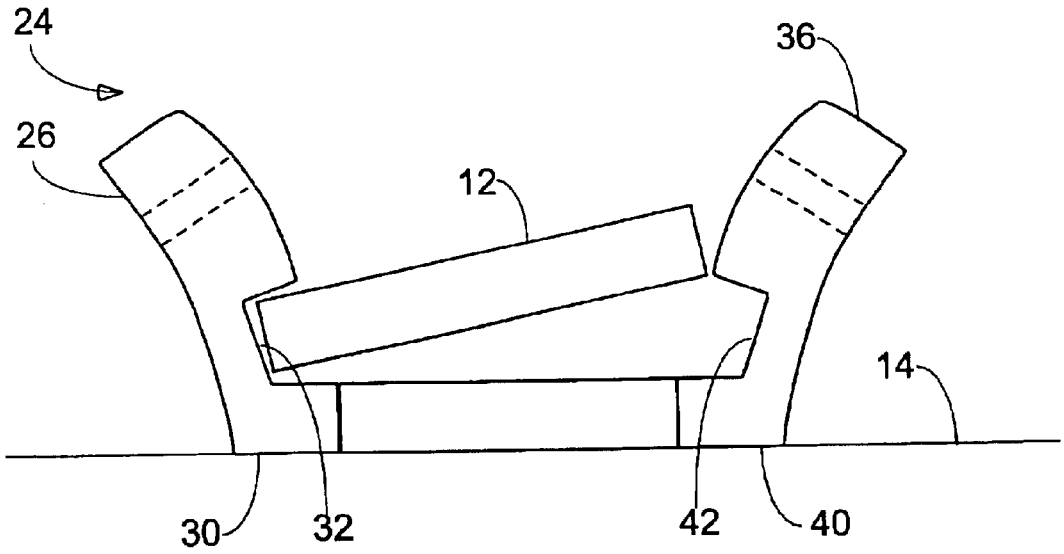
FIG. 5 is a diagrammatic illustration of the connection of an acoustic sensor element to a complete mounting bracket.
Figure 7:
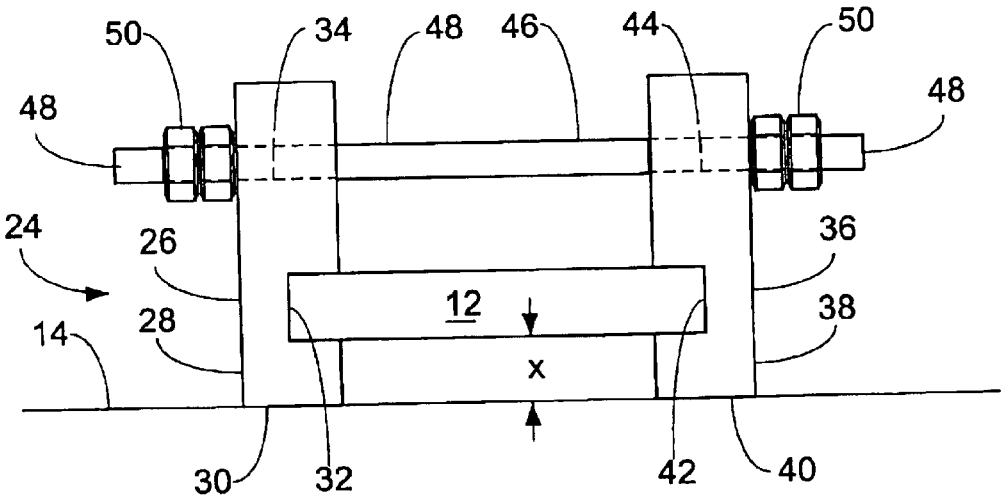
FIG. 7 is a front elevational view of an alternative embodiment.

As shown in FIGS. 5 and 7, the mounting bracket 24 includes a second protrusion 36 comprising a block 38, typically of the same material as the block 28 (FIG. 3), and provided with a first end 40 fixed to the shell inside surface 14, a widthwise slot 42 opposed to the slot 32 of the block 28, and, optionally, a bore 44 whose purpose is discussed hereinbelow.

Figure 6:
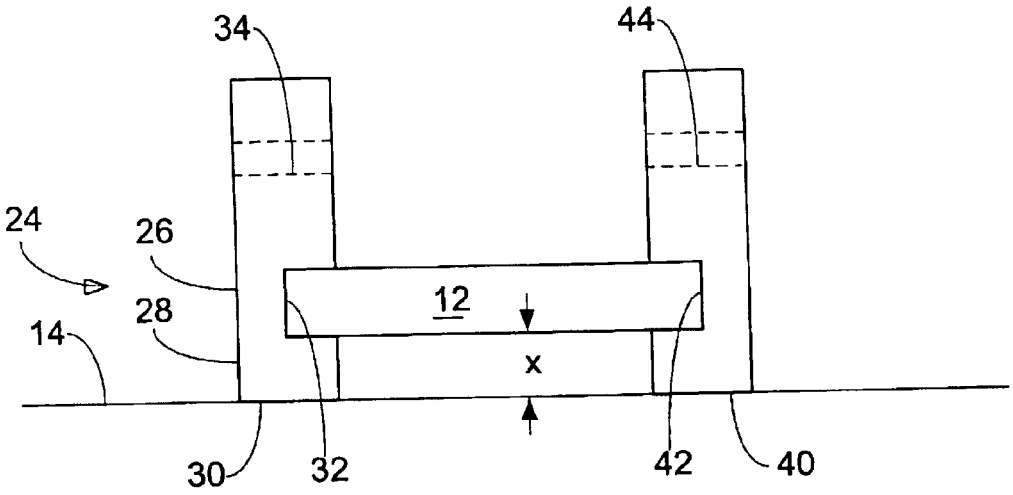
FIG. 6 is a front elevational view of the complete mounting bracket with the acoustic sensor element in place.

In FIGS. 5–7, it will be seen that the two blocks 28, 38 are adapted to receive in their respective slots 32, 42 an acoustic element 12. The blocks, if both of polyurethane, are sufficiently flexible to be manually deformed sufficiently for the element 12 to be wedged into the slots 32, 42. Upon release of the blocks 28, 38, the blocks snap back into parallel positions, holding the element 12 therebetween (FIG. 6).

The blocks 28, 38 may be of a harder, firmer material, such as a polycarbonate resin, but it is critical that at least one of the blocks be sufficiently flexible to permit removal of an element 12 and insertion of a replacement element. It is further critical that the material of the blocks be acoustically "clear" material and of a material which can be bonded to fiberglass or other bondable material of which the shell is made.

Referring to FIG. 7, it will be seen that the mounting bracket 24 may include a restraining member 46 which may comprise a threaded PVC restraint rod 48 extending through the bores 34, 44 and secured by PVC units 50. Depending upon the flexibility of the blocks 28, 38, other restraining members, such as spring clips, nylon tips, rubber bands, and the like (not shown), may be used. The use of restraints and, if so, the selection of restraints, depends in large measure on the flexibility of the protrusions 26, 36 and the dynamic loading expected.

Figure 8:
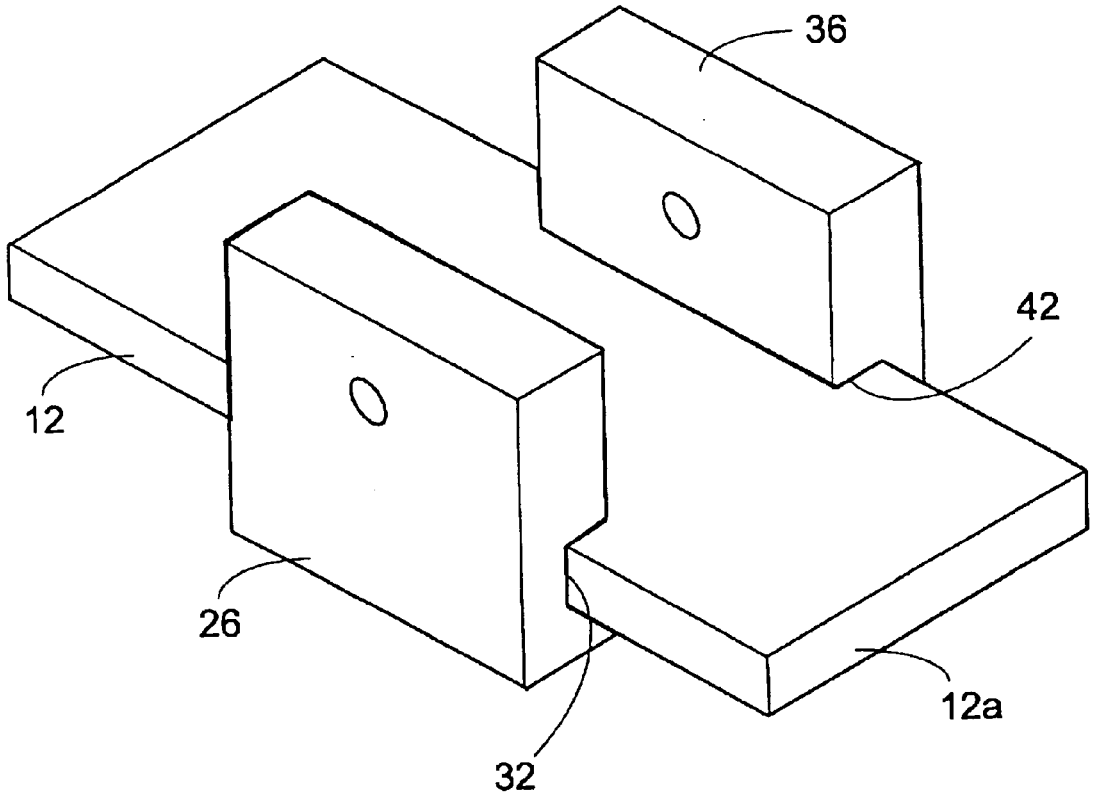
FIG. 8 is a perspective view of the mounting bracket of FIG. 6, showing a manner in which the mounting bracket may be used.

As shown in FIG. 8, each block slot 32, 42 can receive corner portions of two elements 12, 12*a*.

As may be seen in FIG. 6, the acoustic element 12 is positioned by the protrusions 26, 36 a selected distance from the inside surface 14 of the shell 16. Inasmuch as the dome 10 is free-flooded, the area between the element and the inside surface of the shell will present a layer of sea water, assuring excellent acoustic coupling between the elements and the nearby dome wall. In a preferred embodiment of the invention, the stand-off distance from the inside surface is of the order of ⅛th inch.

There is thus provided a sonar dome of improved construction and performance, and mounting brackets therein for the acoustic elements, which mounting brackets are free from adhesive interconnection to the elements, retain the elements securely but in readily releasable fashion, which elements are of acoustically transparent material, and which dome construction provides a layer of sea water between the elements and the proximate dome wall.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A mounting bracket for removably connecting an acoustic sensor element to an inside wall of a sonar dome of a marine vessel, the mounting bracket comprising:

a first protrusion bonded at a first end thereof to the inside wall of the sonar dome and extending inwardly therefrom, the first protrusion being provided with a first widthwise extending slot in a side thereof, the first slot being spaced from the inside wall;

a second protrusion bonded at a first end thereof to the inside wall of the sonar dome and extending inwardly therefrom and spaced from said first protrusion, the second protrusion being provided with a widthwise extending second slot in a side thereof, the second slot being spaced from the inside wall and being opposed to and in alignment with the first slot;

the slots being adapted to receive portions of the acoustic sensor element and to hold the acoustic sensor element in a position proximate to and removed from the inside wall of the sonar dome; and at least one of said first and second protrusions being sufficiently flexible to permit bending of the protrusion to facilitate insertion of the acoustic sensor element into the first and second slots, and being sufficiently rigid to snap back into a non-bent configuration to lock the acoustic sensor element in the first and second slots.

2. The mounting bracket in accordance with claim 1 and further comprising a restraint member for maintaining said protrusions in positions holding the acoustic sensor element therebetween.

3. The mounting bracket in accordance with claim 2 wherein said restraint comprises a rigid rod.

4. The mounting bracket in accordance with claim 1 wherein said at least one protrusion is of polyurethane.

5. The mounting bracket in accordance with claim 1 wherein each of the slots is adapted to receive corner portions of two of the acoustic sensor elements.

6. The mounting bracket in accordance with claim 3 wherein each of said protrusions is provided with a bore extending therethrough and adapted to receive said rod therein.

7. The mounting bracket in accordance with claim 1 wherein said first and second protrusions comprise polyurethane blocks, the inside wall of the sonar dome is made of a selected one of a class of materials consisting of (i) fiberglass and rubber composite material, (ii) fiberglass, and (iii) rubber and steel, and said first ends of said protrusions are attached to the sonar dome inside wall by an epoxy resin.

8. The mounting bracket in accordance with claim 7 wherein said sonar dome is made of fiber glass and said protrusions are fixed to said sonar dome by an epoxy resin.

9. The mounting bracket in accordance with claim 1 wherein the slots are spaced from the dome inside wall sufficiently to provide a space between the inside wall and the acoustic sensor element, the space being filled with seawater in operation of the dome.

10. The mounting bracket in accordance with claim 1 wherein said protrusions are parallel to each other.

11. A sonar dome assembly for marine vessels, the assembly comprising:

a shell for attachment to an outboard surface of an underwater portion of a vessel;

a plurality of mounting brackets fixed to an inboard surface of said shell; and a plurality of acoustic sensor elements releasably held on said mounting brackets;

said mounting brackets each comprising two protrusions for retaining sensor elements mounted thereon spaced from the shell inboard surface;

wherein the protrusions are adapted to be spread apart to release and receive the sensor elements, and are adapted to snap toward each other when not restrained, to clamp one of the sensor elements therebetween.

12. The assembly in accordance with claim 11 wherein said shell is made of a selected one of a group of materials consisting of (i) fiberglass, (ii) fiberglass and rubber composite, and (iii) rubber and steel, and said mounting brackets are fixed to said shell by an adhesive.

13. The assembly in accordance with claim 12 wherein said shell is made of a fiberglass and rubber composite material, and the inboard surface thereof is fiberglass and said mounting brackets are fixed to said bound surface by an epoxy resin.

14. The assembly in accordance with claim 11 wherein at least one of the protrusions of said mounting is sufficiently flexible to be bent to permit insertion of the sensor element between the projections.

15. The assembly in accordance with claim 11 wherein space between the shell inboard surface and the sensor elements is free flood with seawater.

* * * * *